United States Patent [19]

Lee

[11] 4,266,306

[45] May 12, 1981

[54] BATH SEAT FOR BABIES

[76] Inventor: Seung B. Lee, 258-16 Sooyoo-dong, Dobong-ku, Seoul, Rep. of Korea

[21] Appl. No.: 46,949

[22] Filed: Jun. 8, 1979

[30] Foreign Application Priority Data

Aug. 13, 1978 [KR] Rep. of Korea ..... 4840/1978

[51] Int. Cl.[3] ..... A47K 3/024; A47K 3/164; A47C 3/20

[52] U.S. Cl. ..... 4/572; 4/659; 248/408; 297/338; D23/52

[58] Field of Search ..... 4/185 R, 185 S, 185 AB, 4/185 B, 185 HB, 134, 185 L, 251, 571–573, 578, 586, 587, 654, 659, 546, 495, 496, 515–517, 522, 523, 579, 590; 297/338, 345, 313; D23/52; 248/394, 396, 408, 409

[56] References Cited

U.S. PATENT DOCUMENTS

| | | | |
|---|---|---|---|
| 822,472 | 6/1906 | Perkins | 297/313 X |
| 975,016 | 11/1910 | Bürgel | 4/185 AB |
| 2,285,900 | 6/1942 | Chapman | 4/185 B |
| 2,495,965 | 1/1950 | Gustaveson | 4/185 B |
| 2,834,968 | 5/1958 | Hefley | 4/185 S |
| 3,022,037 | 2/1962 | Stallard | 297/338 X |
| 4,074,886 | 2/1978 | Yates | 248/396 X |

FOREIGN PATENT DOCUMENTS

| | | | |
|---|---|---|---|
| 2616802 | 12/1976 | Fed. Rep. of Germany | 248/396 |
| 14521 | 2/1978 | Rep. of Korea . | |

*Primary Examiner*—Stuart S. Levy
*Attorney, Agent, or Firm*—Oblon, Fisher, Spivak, McClelland & Maier

[57] ABSTRACT

A bath seat for babies which includes a seat having at least one hole formed on a central portion of a curved upper surface thereof and groove portions formed at a central portion of opposite sides of the seat, a first and second catch member disposed within the groove portions, a base member disposed beneath the seat, a plurality of supporting plates connected to the base and including idle-holes formed therein, a plurality of support legs connected to the seat and a first and second supporting rod connected to said supporting legs, adjustably positioned within the idle-holes of the supporting plates and connected to end portions of the first and second catch members, respectively, for adjustment of positioning within the idle-holes of the supporting plates and corresponding positioning of said seat.

7 Claims, 4 Drawing Figures

BATH SEAT FOR BABIES

BACKGROUND OF THE INVENTION

1. Field of the Invention:

The present invention relates to a bath seat for babies and more particularly to a bath seat for babies the height and inclination of which are adjustable.

2. Background of the Invention:

Hitherto, when a person intended to bathe a baby, such a person had to hold the baby in one arm and give the baby a bath with the other arm. However, in this manner, a great deal of effort to support the baby was necessary, particularly when soap is used which may cause the baby to slip or fall into the bath, thereby causing an injury to various portions of the baby's body.

Further, there has been provided a bath seat for babies wherein gears provided at both sides of the lower part of the seat and gears mounted on the upper lever are engaged with each other such that the height and the inclination thereof is adjustable (i.e. see Korean Utility Model Registration No. 14,512 granted to the inventor). Nevertheless, the operation of such seat was very complicated and hence not economical.

SUMMARY OF THE INVENTION

The object of the present invention is to provide a bath seat for a baby so as to avoid the significant risk of injury otherwise present when bathing a baby.

A further object of the present invention is to provide an adjustable bath seat for a baby for assisting in the aforementioned object of the present invention and to avoid the deficiencies of the prior art.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

BRIEF DESCRIPTION OF THE PREFERRED EMBODIMENT

Figure 1:
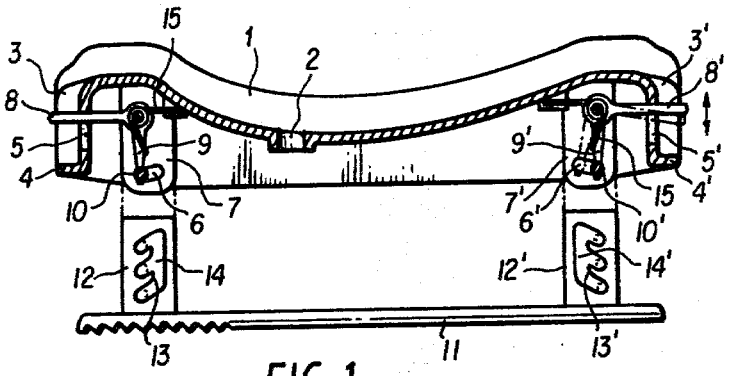
FIG. 1 is a longitudinal sectional view of the seat according to the present invention.
Figure 2:
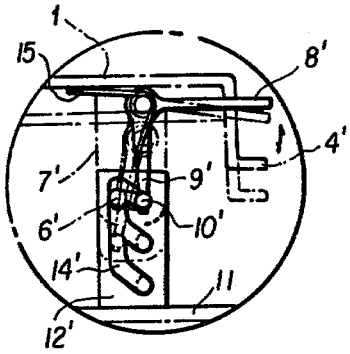
FIG. 2 is a view showing operation of the seat shown in FIG. 1 according to the present invention.
Figure 3:
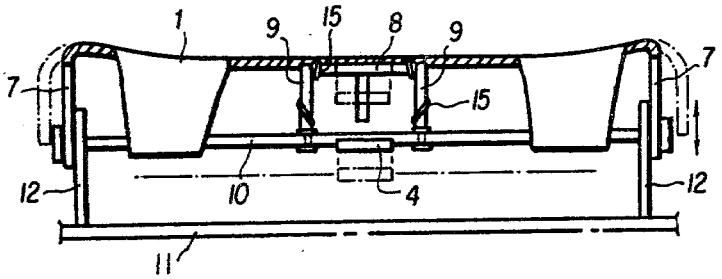
FIG. 3 is a cross sectional view of a part of the seat according to the present invention.
Figure 4:
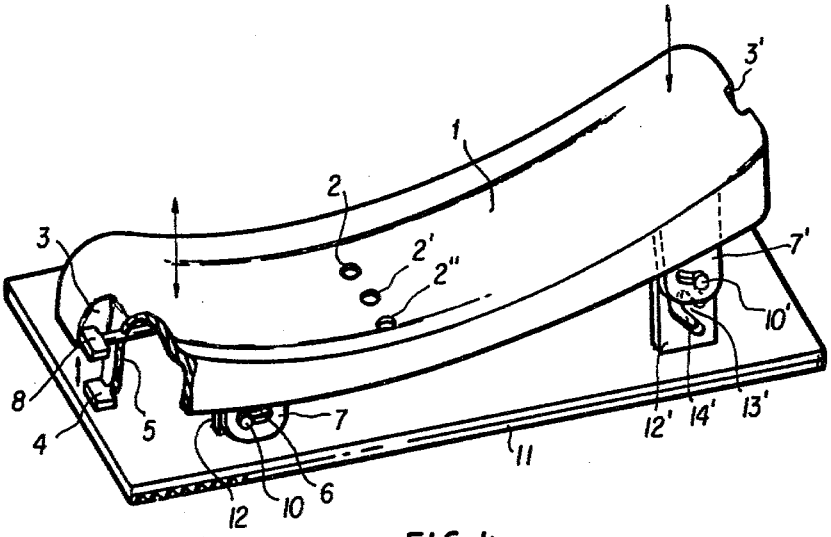
FIG. 4 is a perspective view of the seat according to the present invention, a part of which is cut away for purposes of more clearly illustrating the same.

The seat (1) has drain holes (2) (2') (2'') on the central part of the curved upper surface thereof and grooves (3) (3') are provided at opposite sides of the seat and further includes, at the underside portion of the seat, protruding catches (4) (4'). Furthermore, holes (5')(5') are provided within the grooves (3)(3') so that associated levers (8)(8') can be operated upwardly and elongated downwardly and supporting legs (7)(7') are provided with corresponding idle-holes (6)(6').

The fore end of a pair of operating lever arms (9)(9'), which are integrally constructed to form an L-shaped lever member with levers (8)(8') fixed in parallel to the catches (4)(4') passing through the holes (5)(5'), are secured to supporting rods (10)(10') which are disposed within holes (6)(6'). The rods (10)(10') pass through E-shaped idle holes (14)(14') in first and second vertically extending supporting plates (12)(12') having multi-stage supporting means (13)(13') which cooperate with the holes (6)(6') formed on the plates (7)(7') and the supporting plates are connected to a base (11). Reference numeral 15 denotes pin springs which cooperate with levers 8, 8' and lever arms 9, 9' for biasing the supporting rods into engagement with the supporting means and supporting levers (8)(8') and lever arms (9)(9').

The function and effect of the seat according to the invention will be described hereinbelow. In adjusting the inclination of the seat (1), if one simultaneously holds catch (4) and lever (8) and, upon lifting the seat (1), presses the lever (8) downwardly to the catch (4), the lever arm (9) which is resiliently supported by pin spring (15) is moved upwardly. When a desired inclination is obtained, if the lever (8) is set free, the rod (10) can be smoothly placed and fixed in supporting means (13) by the spring biasing force of the pin spring (15). p To the contrary, in order to return the seat to its original position, one simultaneously holds catch (4) and lever (8) and, upon lifting the seat (1), presses the lever (8) downwardly to the catch (4), the lever arm (9) is moved upwardly and, subsequently the rod (10) which is fixedly connected with the lever arm (9) is lifted into the E-shaped hole (14). At the same time, when a desired height is reached, upon releasing the lever (8), the rod (10) can be firmly placed in the E-shaped hole (14) by means of a pin spring (15) secured to the lever arm (9). Similarly, since the inclination of the opposite sides of the seat (1) is also adjustable, the seat (1) can be horizontally lifted, lowered or inclined at will.

In order to lower the part on which the baby's legs are placed, when the lever arm (9) which is resiliently supported by pin spring (15) is moved upwardly by simultaneously holding catch (4) and lever (8) and while lifting the seat (1) while still pressing the lever (8) downwardly to said catch (4), the rod (10) can be smoothly placed and fixed in the supporting means (13) by the spring biasing force of the pin spring (15).

Namely, at that time, the lever arm (9) is moved upwardly along with the idle-hole (6) provided on the supporting leg (7) and the multi-stage supporting means (13) formed on the E-shaped hole (14), and the rod (10) is passed over the fore end of the supporting means (13) upon reaching a certain inclination.

In order to lift the position of the seat, upon simultaneously holding catch (4) and lever (8) downwardly to the catch (4), the lever arm (9) is moved upwardly and subsequently the rod (10), which is fixedly connected with the lever arm (9), is lifted into the E-shaped hole (14). At that time, when a desired height is reached and upon releasing the lever (8), the rod (10) can be firmly placed in the supporting means (13) by means of pin spring (15) secured to thelever arm (9).

Thus, the seat of the present invention can be adjusted and controlled at any of the positions in lifting or lowering the seat or the inclination can be adjusted as desired and hence, one may bathe a baby in safety at a desired position on the seat by himself without any risk of injury to the baby.

The seat according to the present invention also utilizes a base (11) which will not slip even on a flat surface.

Obviously, many modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States of America is:

1. A bath seat for babies comprising:

a seat including at least one hole formed on a central part of a curved upper surface thereof and groove portions formed at a central portion of opposite sides of said seat;

a first and second lever member disposed within said groove portions and each including lower end portions;

a base member disposed beneath said seat;

a plurality of vertically extending supporting plates connected to said base and including first idle-holes formed therein;

a plurality of elongated support legs connected to said seat, downwardly extending therefrom, and having second idle-holes formed therein, said lever members being pivotably mounted on said support legs; and first and second supporting rods connected to said lower end portions of said first and second lever members, adjustably positioned within said idle-holes of said supporting plate and said support leg and connected to said end portions of said first and second lever members, respectively, for adjustment of positioning within said idle-holes of said supporting rods and corresponding positioning of said seat.

2. Bath seat as set forth in claim 1 further comprising:

biasing means connected to said seat for biasing said first and second lever members to position said supporting rods within said idle-holes of said supporting plates.

3. A bath seat as set forth in claim 2, said baising means comprising a pin spring member.

4. A bath seat as set forth in claim 1, said idle-holes formed in said supporting plates comprising E-shaped idle holes.

5. A bath seat as set forth in claim 1 further comprising biasing means connected to said seat for biasing said first and second lever members to position said supporting rods within said idle-holes of said supporting plates, said idle-holes formed in said supporting plates comprising E-shaped idle-holes.

6. A bath seat as set forth in claim 1 further comprising biasing means connected to said seat for biasing said first and second lever members to position said supporting rods within said idle-holes of said supporting plates, said biasing means comprising a pin spring member in said idle-holes formed in said supporting plates comprising E-shaped idle holes.

7. A bath seat as set forth in claim 1, wherein said lever members comprise L-shaped lever members.

* * * * *